US005103608A

United States Patent [19]

Andreo

[11] Patent Number: 5,103,608

[45] Date of Patent: Apr. 14, 1992

[54] NON-SLIP LUMINESCENT DEVICE FOR SURFACES SUCH AS STAIR TREADS

[75] Inventor: Jorge O. Andreo, Belle Plaine, Kans.

[73] Assignee: Balco, Inc., Wichita, Kans.

[21] Appl. No.: 658,958

[22] Filed: Feb. 22, 1991

[51] Int. Cl.[5] ..... E04F 15/00

[52] U.S. Cl. ..... 52/179; 52/181

[58] Field of Search ..... 52/179, 181, 188; 404/12, 14, 16

[56] References Cited

U.S. PATENT DOCUMENTS

| | | | |
|---|---|---|---|
| 3,334,456 | 8/1967 | Naka | 52/179 |
| 3,589,087 | 6/1971 | DeLazzero | 52/181 |
| 4,112,641 | 9/1978 | Balzer | 52/179 |
| 4,385,586 | 5/1983 | Schriever | 52/174 X |
| 4,758,469 | 7/1988 | Lange | 404/14 X |
| 4,998,391 | 3/1991 | Connew | 52/179 |

OTHER PUBLICATIONS

Wooster Safety Treads Catalog 50 Wooster Products Inc. Wooster, Ohio p. 3 type M90, 198 & M95 Jan. 1, 1960.

*Primary Examiner*—David A. Scherbel
*Assistant Examiner*—Robert Canfield
*Attorney, Agent, or Firm*—Hovey, Williams, Timmons & Collins

[57] ABSTRACT

An improved stair nosing device especially useful in temporarily darkened stairways is provided which includes a plate member with an upper surface, at least a portion of which is covered by luminescent material. The stair nosing device includes non-slip material attached to the upper surface to provide increased frictional contact with foot traffic relative to the plate member. The non-slip material is attached as spaced apart strips with an upper surface of the non-slip material being higher relative to the plate member. In this way the luminescent material is protected from damage by foot traffic.

22 Claims, 1 Drawing Sheet

NON-SLIP LUMINESCENT DEVICE FOR SURFACES SUCH AS STAIR TREADS

BACKGROUND OF THE INVENTION

1. Field of the Invention

The present invention is concerned with an improved non-slip luminescent device in the preferred configuration of a stair nosing for providing increased safety in negotiating darkened stairs, for example, during such times as a power outage.

2. Description of the Prior Art

Various means have been employed to assist people in negotiating darkened stars. For instance, electric light strips have been placed on or next to stairs to provide guidance. These contrivances provide assistance under most conditions but in the event of a power failure, assistance will not be provided when needed most. Also, these electrical lighting means require constant maintenance, such as changing burned out bulbs. Hence, the prior art points out the need for stair illumination which is not dependent on a continuous power source and which requires low maintenance.

SUMMARY OF THE INVENTION

The problems outlined above are, in large measure, solved by the non-slip luminescent device in accordance with the present invention. That is to say, the preferred stair nosing hereof provides both a means for good traction and illumination when the stair way is temporarily dark.

The stair nosing in accordance with the present invention broadly includes alternating strips of a luminescent material and a non-slip substance. The luminescent material of the stair nosing stores up energy while the stairway area is lighted by either natural or artificial light. When teh stairway area is darkened, the luminescent material emits the stored energy in the form of visible light, thus alerting users of the area to the presence of the stairs.

The non-slip strips provide a contrast to the radiance of the luminescent strips and by alternating the two types of strips the awareness of the stair is enhanced. In the preferred embodiment, the strips cooperate to form a foot engaging surface which is presented at a higher elevation relative to the luminescent strips. With this arrangement, foot traffic contacts only the tread surface and the recessed luminescent material is protected from excessive damage and wear.

DESCRIPTION OF THE PREFERRED EMBODIMENT

Figure 1:
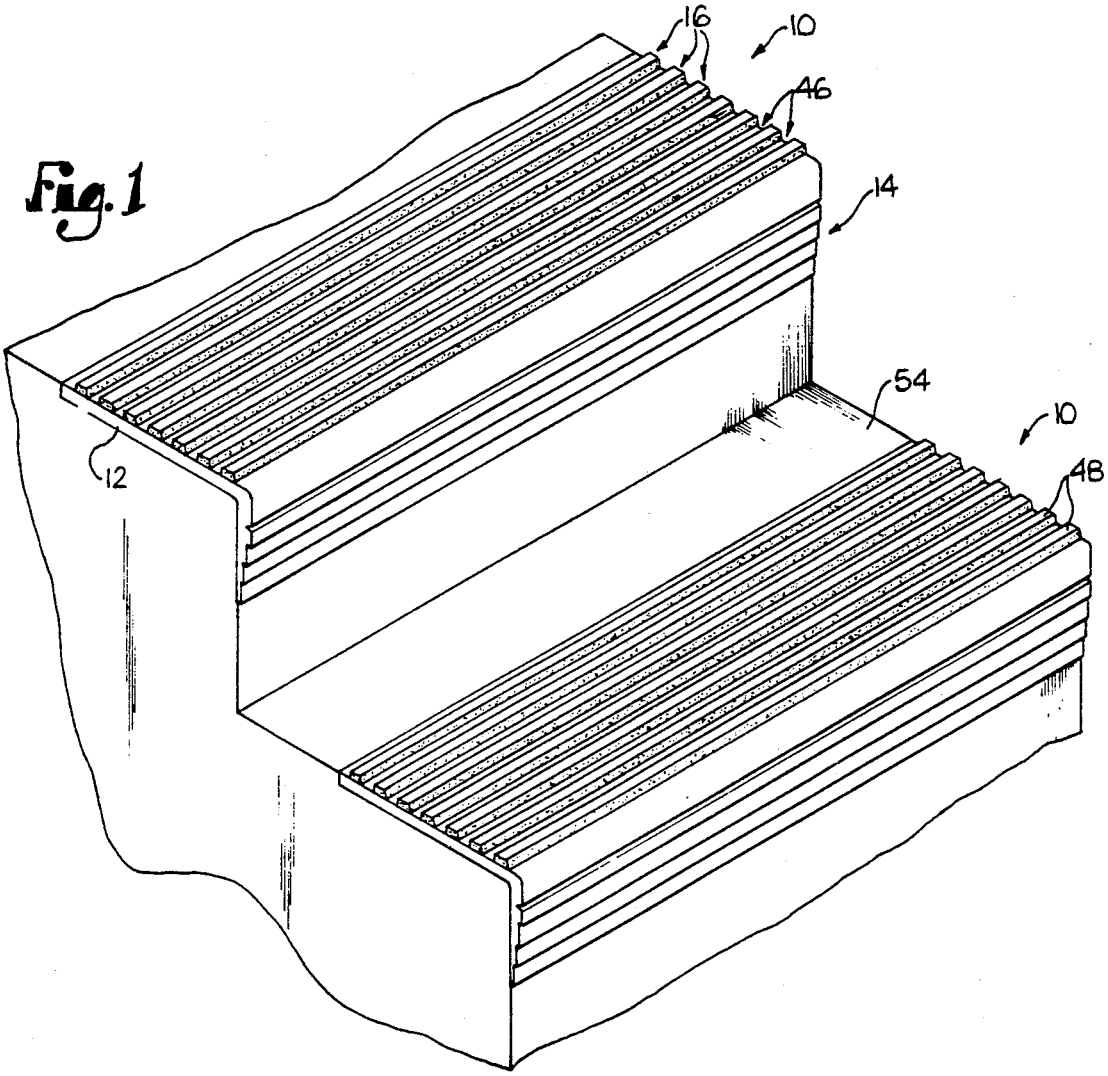
FIG. 1 is a perspective view of the stair tread in accordance with the invention.

Referring to the drawing figures, a stair tread 10 in accordance with the invention broadly includes a plate member 12, a face plate 14, a plurality of tread fillets 16 and a luminescent covering 18.

Figure 2:
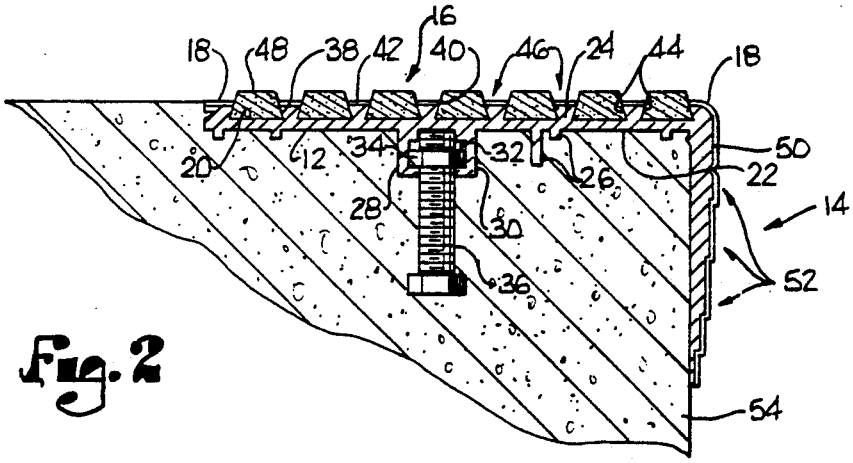
FIG. 2 is a vertical sectional view of the stair tread of FIG. 1.

In more detail, plate member 12 is preferably formed of extruded aluminum which has been heat treated for strength. Referring to FIG. 2, member 12 presents an upper face 20 and a lower face 22. A plurality of spaced, parallel, upstanding walls 24 extend from upper face 20, and a plurality of stiffening and anchoring support ribs

26 extend from lower face 22. A pair of spaced, parallel, opposed anchor walls 28 and 30 also extend from lower face 22 and cooperatively form an anchor slot 32 for receiving a nut 34 and a portion of a bolt 36 therein.

Upstanding walls 24 span the length of tread 10. Each wall 24 presents a generally trapezoidal shape in cross section and side surfaces 38 and 40 and an apogee 42. Respective side surfaces 38 cooperate with side surface 40 of adjacent walls 24 and with upper surface 20 to form a plurality of chases 44 for receiving tread fillets 16 therein.

Luminescent covering 18 is preferably in the form of Lumilux-N pigment from P.J.P. Trading of Hatfield, England carried by a two part epoxy paint. Covering 18 is applied to apogees 42 thereby forming a plurality of spaced, generally parallel, luminescent strips 46.

In the preferred embodiment, tread fillets 16 composed of aluminum oxide granules in a two part epoxy resin, span the length of plate member 12, and present generally trapezoidal shapes such that tread fillets 16 matingly fit within chases 44 in an essentially dovetail configuration. Tread fillets 16 cooperatively present a top surface 48 at a higher elevation relative to luminescent strips 46.

In the preferred embodiment illustrated in the drawings, face plate 14 is attached perpendicular to and along the forward edge of plate member 12 and presents an outer surface 50. In more detail, face plate 14 is formed of a plurality of generally planar sections 52 of varying thicknesses with the thickest planar section 52 connected at the intersection with plate member 12, and with the other planar sections 52 becoming progressively thinner at a distance from plate member 12.

Preferably, stair tread 10 is installed by attaching tread 10 to a concrete stair 54, as shown in FIGS. 1 and 2, with nut 34 and bolt 36 received within anchor slot 32. Next, stair tread 10 is positioned on concrete forms during construction so that when the concrete is poured, bolt 36 is encased in the concrete as shown in FIG. 2. It will be appreciated by those skilled in the art that stair tread 10 may also be attached to other stair materials such as wood or metal. Also, it should be readily apparent that anchors other than a nut and bolt may be fashioned to fit within opening 32.

Stair tread 10 may also be integrally composed of a sub-channel and a tread plate. In this configuration the sub-channel is attached to stair 54 during pouring of the concrete or with the installation of other types of stairs. The tread plate may then be attached to the sub-channel after construction to prevent damage and costly clean-up of the tread plate.

After installation, luminescent strips 46 absorb light energy while a stairway is lighted and during subsequent darkness, emits the stored energy as visible light. Tread fillets 16 provide alternating contrast to the radiance of luminescent strips 46 and thereby enhance the awareness of stair tread 10. This allows the stairs to be used quickly, efficiently and safely when the stairs are darkened, for example, during power failures or other emergency situations.

The preferred configuration of tread 10 also reduces maintenance because top surface 48 has an upper face which is at a higher elevation relative to luminescent strips 46. Because of this, foot traffic only contacts top surface 48 and luminescent material 18 is protected from excessive damage and wear by foot traffic.

As those skilled in the art will appreciate, it is noted that substitutions may be made for the preferred embodiment and equivalents employed herein without departing from the scope of the present invention as recited in the claims. For example, plate member 12 could be composed of materials such as wood, plastic or steel rather than the preferred aluminum. Also, luminescent covering 18 could be luminous plastic or the luminescence of stair tread 10 could be achieved by forming plate member 12 from a luminous compound. In addition, tread fillets 16 can be made of various materials and attached to plate member 12 in a variety of ways. The present invention finds additional utility without the preferred face plate 14. In this mode, tread 10 can be placed on planar surfaces other than stairways such as hallways or other places where safety illumination may be needed.

Having thus described the preferred embodiment of the present invention, the following is claimed as new and desired to be secured by Letters Patent:

1. An apparatus comprising:

a plate member presenting an upper surface;

luminescent means covering at least a portion of said upper surface for providing luminosity to said upper surface; and non-slip means attached to said upper surface for providing increased frictional contact with foot traffic relative to said plate member, said plate member including a forward face plate connected to said plate member to present a right angle configuration for coupling with a stair, wherein said luminescent means covers at least a portion of said forward face plate.

2. The apparatus of claim 1, said plate member being composed of metal.

3. The apparatus of claim 2, said plate member being composed of aluminum.

4. The apparatus of claim 1, said plate member presenting a lower surface wherein said lower surface includes an anchor slot for use in attaching said plate member to a floor surface.

5. The apparatus of claim 1, wherein said forward face plate is of a thickness which tapers from the connection with said plate member.

6. The apparatus of claim 5, wherein said taper of said forward face plate includes a plurality of progressively thinner generally planar sections.

7. The apparatus of claim 1, said plate member presenting a lower surface wherein said lower surface includes an anchor slot for use in attaching said plate member to a floor surface.

8. The apparatus of claim 1, said plate member being of integral construction.

9. The apparatus of claim 8, said integral construction including a sub-channel and a tread plate.

10. The apparatus of claim 1, said luminescent means being composed of luminous paint.

11. The apparatus of claim 1, said non-slip means being composed of aluminum oxide granules in a two part epoxy resin.

12. The apparatus of claim 1, said non-slip means presenting a top surface wherein said top surface is above the level of said upper surface of said plate member.

13. An apparatus comprising:

a plate member presenting an upper surface;

luminescent means covering at least a portion of said upper surface for providing luminosity to said upper surface; and non-slip means attached to said upper surface for providing increased frictional contact with foot traffic relative to said plate member, said upper surface of said plate member including a plurality of spaced generally parallel upstanding walls wherein each of said walls includes and apogee with said luminescent means covering said apogee.

14. The apparatus of claim 13, wherein said walls have a trapezoidal cross section shape.

15. The apparatus of claim 13, said walls forming a plurality of chases for receiving non-slip means therein.

16. An apparatus comprising:

a plate member presenting an upper surface;

luminescent means covering at least a portion of said upper surface for providing luminosity to said upper surface; and non-slip means attached to said upper surface for providing increased frictional contact with foot traffic relative to said plate member, said non-slip means further including a plurality of tread fillets each presenting a top and bottom surface, wherein said bottom surfaces are attached to said plate member in spaced, generally parallel relative orientation spanning the length of said plate member, wherein said luminescent means covers said upper surface of said plate member between said tread fillets.

17. The apparatus of claim 16, wherein said top surfaces of said tread fillets are above the level of said upper surface of said plate member.

18. The apparatus of claim 17, said plate member including a forward face plate connected to said plate member to present a right angle configuration for coupling with a stair.

19. The apparatus of claim 18, wherein said luminescent means covers at least a portion of said forward face plate.

20. An apparatus comprising:

a plate member presenting an upper surface;

luminescent means covering at least a portion of said upper surface for providing luminosity to said upper surface; and non-slip means attached to said upper surface for providing increased frictional contact with foot traffic relative to said plate member wherein said non-slip means further includes a plurality of tread fillets each presenting a top and bottom surface, wherein said bottom surfaces are attached to said upper surface in a spaced, generally parallel relative orientation spanning the length of said plate member and said top surfaces of said tread fillets are above the level of said upper surface of said plate member, wherein said luminescent covers at least a portion of said forward face plate.

21. The apparatus of claim 20, said plate member including a forward face plate connected to said plate member to present a right angle configuration for coupling with a stair.

22. A non-slip, luminescent device for supporting and guiding foot traffic in a darkened area, said device comprising:

a plurality of elongated, luminescent strips each presenting an upper strip face;

a plurality of elongated, tread fillets each presenting a non-slip upper fillet face; and means for supporting said strips and fillets in a strip-fillet alternating, parallel relationships in order to present said luminescent strips in a visually contrasting arrangement, said upper fillet faces cooperatively presenting a tread surface for supporting foot traffic;

said supporting means further including means for presenting said tread surface at a higher elevation than said strip faces for preventing contact therewith by foot traffic trodding on said tread surface.

* * * * *